US011332970B2

(12) United States Patent
Jones

(10) Patent No.: US 11,332,970 B2
(45) Date of Patent: May 17, 2022

(54) DOOR OPENING ASSEMBLY FOR APPLIANCE

(71) Applicant: WHIRLPOOL CORPORATION, Benton Harbor, MI (US)

(72) Inventor: Christopher A. Jones, St. Joseph, MI (US)

(73) Assignee: Whirlpool Corporation, Benton Harbor, MI (US)

( * ) Notice: Subject to any disclaimer, the term of this patent is extended or adjusted under 35 U.S.C. 154(b) by 0 days.

(21) Appl. No.: 17/136,100

(22) Filed: Dec. 29, 2020

(65) Prior Publication Data

US 2021/0115722 A1 Apr. 22, 2021

Related U.S. Application Data

(62) Division of application No. 16/569,687, filed on Sep. 13, 2019, now Pat. No. 10,907,397.

(51) Int. Cl.
*E05F 15/63* (2015.01)
*D06F 39/14* (2006.01)

(52) U.S. Cl.
CPC ..... *E05F 15/63* (2015.01); *D06F 39/14* (2013.01); *E05Y 2900/312* (2013.01)

(58) Field of Classification Search
CPC ..... D06F 37/10; D06F 37/18; D06F 37/28; D06F 39/14; D06F 2103/40; D06F 2105/44; A47L 15/4259; A47L 15/4261; E05F 15/63; E05F 15/603; E05F 2015/631; E05Y 2900/312
USPC ..... 134/57 DL, 58 DL; 68/12.26, 196; 49/275, 364
See application file for complete search history.

(56) References Cited

U.S. PATENT DOCUMENTS

| | | | | |
|---|---|---|---|---|
| 3,354,583 | A | 11/1967 | Moorman et al. | |
| 5,724,837 | A | 3/1998 | Shin | |
| 7,819,488 | B2 | 10/2010 | Lee et al. | |
| 8,720,234 | B2 | 5/2014 | Kim et al. | |
| 8,905,494 | B2 | 12/2014 | Kilic | |
| 9,556,552 | B2 | 1/2017 | Park et al. | |
| 10,907,397 | B1 * | 2/2021 | Jones | D06F 39/14 |
| 2015/0015001 | A1 | 1/2015 | Fabbro et al. | |
| 2016/0116891 | A1 | 4/2016 | Megger et al. | |
| 2016/0348919 | A1 | 12/2016 | Ivanovic et al. | |
| 2017/0002504 | A1 | 1/2017 | Jung | |
| 2019/0040654 | A1 | 2/2019 | Dirnberger et al. | |

FOREIGN PATENT DOCUMENTS

| | | | |
|---|---|---|---|
| DE | 102011003818 | A1 | 8/2012 |
| DE | 102017213673 | A1 | 7/2019 |
| EP | 1471201 | A1 | 10/2004 |
| EP | 2497854 | A1 | 9/2012 |

* cited by examiner

*Primary Examiner* — Andrew M Roersma
(74) *Attorney, Agent, or Firm* — Price Heneveld LLP

(57) ABSTRACT

A laundry appliance includes a cabinet and a door rotatably coupled to the cabinet. The door is operable between an opened position and a closed position. A door opening assembly is coupled to one of the cabinet and the door. The door opening assembly includes a motor coupled to a cam. The cam is operably coupled to an actuator arm.

20 Claims, 8 Drawing Sheets

DOOR OPENING ASSEMBLY FOR APPLIANCE

CROSS-REFERENCE TO RELATED APPLICATION

The present application is a divisional of U.S. patent application Ser. No. 16/569,687 filed Sep. 13, 2019, now issued as U.S. Pat. No. 10,907,397, entitled DOOR OPENING ASSEMBLY FOR APPLIANCE, the disclosure to which is hereby incorporated herein by reference in its entirety.

BACKGROUND OF THE DISCLOSURE

The present disclosure generally relates to a door opening assembly, and more specifically, to a door opening assembly for an appliance.

SUMMARY OF THE DISCLOSURE

According to one aspect of the present disclosure, a laundry appliance includes a cabinet and a door rotatably coupled to the cabinet. The door is operable between an opened position and a closed position. A door opening assembly is coupled to one of the cabinet and the door. The door opening assembly includes a motor coupled to a cam. The cam is operably coupled to an actuator arm.

According to another aspect of the present disclosure, a door opening assembly for an appliance includes a support member and a motor coupled to the support member. An actuating cam assembly is operably coupled to the motor. The actuating cam assembly includes a drive shaft that includes a cam and a follower. The motor rotates the drive shaft when activated.

According to yet another aspect of the present disclosure, a door opening assembly for an appliance includes a door panel and a support member coupled to the door panel. A motor is coupled to the support member. A cam is operably coupled to the motor. The motor rotates the cam to a predefined angle. An actuator arm is coupled to the support member. The actuator arm is rotated to a corresponding predefined angle by the cam. The actuator arm is configured to engage an engaging surface of a substrate.

These and other features, advantages, and objects of the present disclosure will be further understood and appreciated by those skilled in the art by reference to the following specification, claims, and appended drawings.

Figure 1:
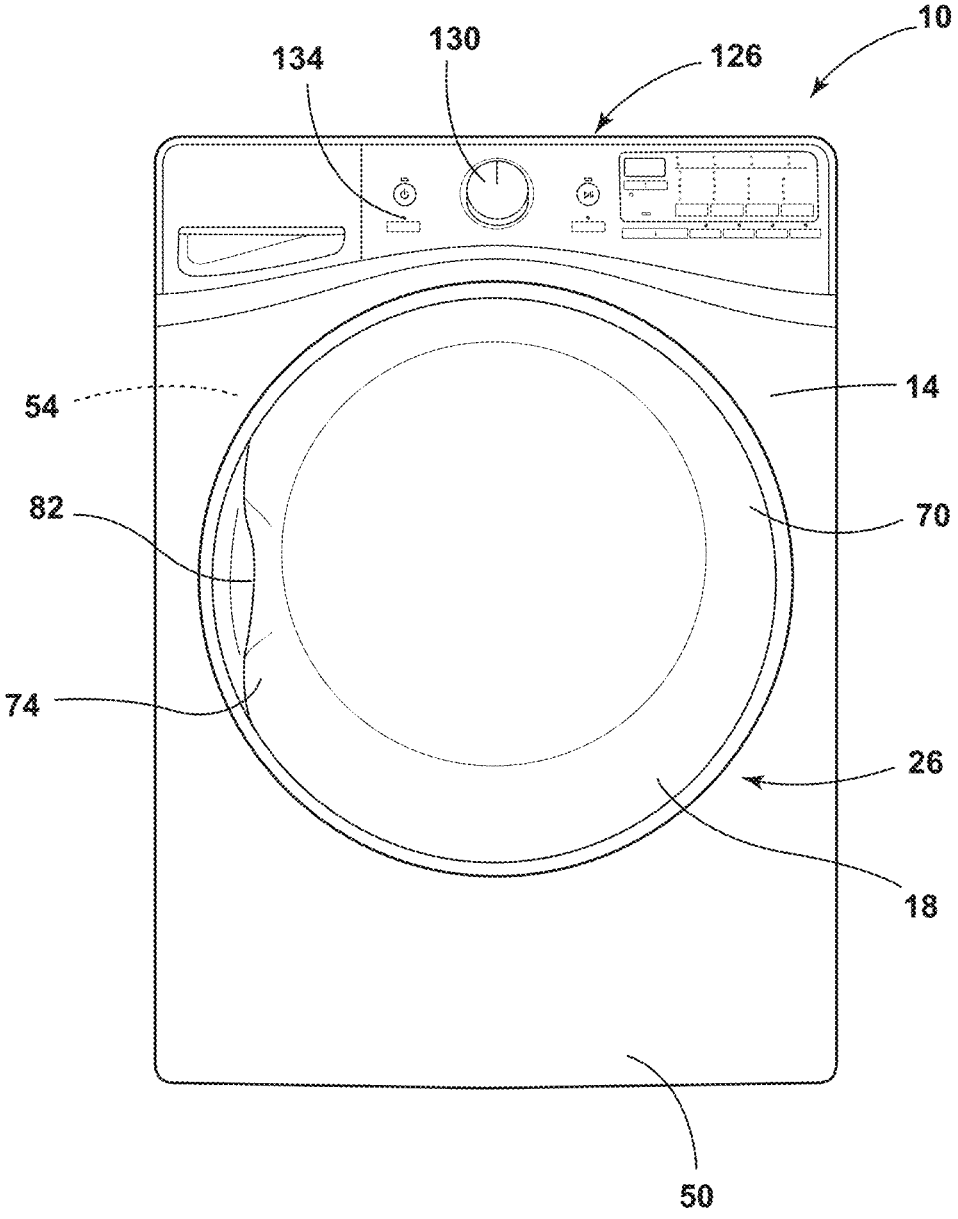
FIG. 1 is a front elevation view of a laundry appliance, according to the present disclosure.

The components in the figures are not necessarily to scale, emphasis instead being placed upon illustrating the principles described herein.

DETAILED DESCRIPTION

The present illustrated embodiments reside primarily in combinations of method steps and apparatus components related to a door opening assembly for an appliance. Accordingly, the apparatus components and method steps have been represented, where appropriate, by conventional symbols in the drawings, showing only those specific details that are pertinent to understanding the embodiments of the present disclosure so as not to obscure the disclosure with details that will be readily apparent to those of ordinary skill in the art having the benefit of the description herein. Further, like numerals in the description and drawings represent like elements.

For purposes of description herein, the terms "upper," "lower," "right," "left," "rear," "front," "vertical," "horizontal," and derivatives thereof shall relate to the disclosure as oriented in FIG. 1. Unless stated otherwise, the term "front" shall refer to the surface of the element closer to an intended viewer, and the term "rear" shall refer to the surface of the element further from the intended viewer. However, it is to be understood that the disclosure may assume various alternative orientations, except where expressly specified to the contrary. It is also to be understood that the specific devices and processes illustrated in the attached drawings, and described in the following specification are simply exemplary embodiments of the inventive concepts defined in the appended claims. Hence, specific dimensions and other physical characteristics relating to the embodiments disclosed herein are not to be considered as limiting, unless the claims expressly state otherwise.

The terms "including," "comprises," "comprising," or any other variation thereof, are intended to cover a non-exclusive inclusion, such that a process, method, article, or apparatus that comprises a list of elements does not include only those elements but may include other elements not expressly listed or inherent to such process, method, article, or apparatus. An element proceeded by "comprises a . . . " does not, without more constraints, preclude the existence of additional identical elements in the process, method, article, or apparatus that comprises the element.

Referring to FIGS. 1-8, reference numeral 10 generally designates a laundry appliance that includes a cabinet 14 and a door 18 rotatably coupled to the cabinet 14. The door 18 is operable between an opened position 22 and a closed position 26. A door opening assembly 30 is coupled to one of the cabinet 14 and the door 18. The door opening assembly 30 includes a motor 34 coupled to a cam 38. The cam 38 is operably coupled to an actuator arm 42.

Figure 2:
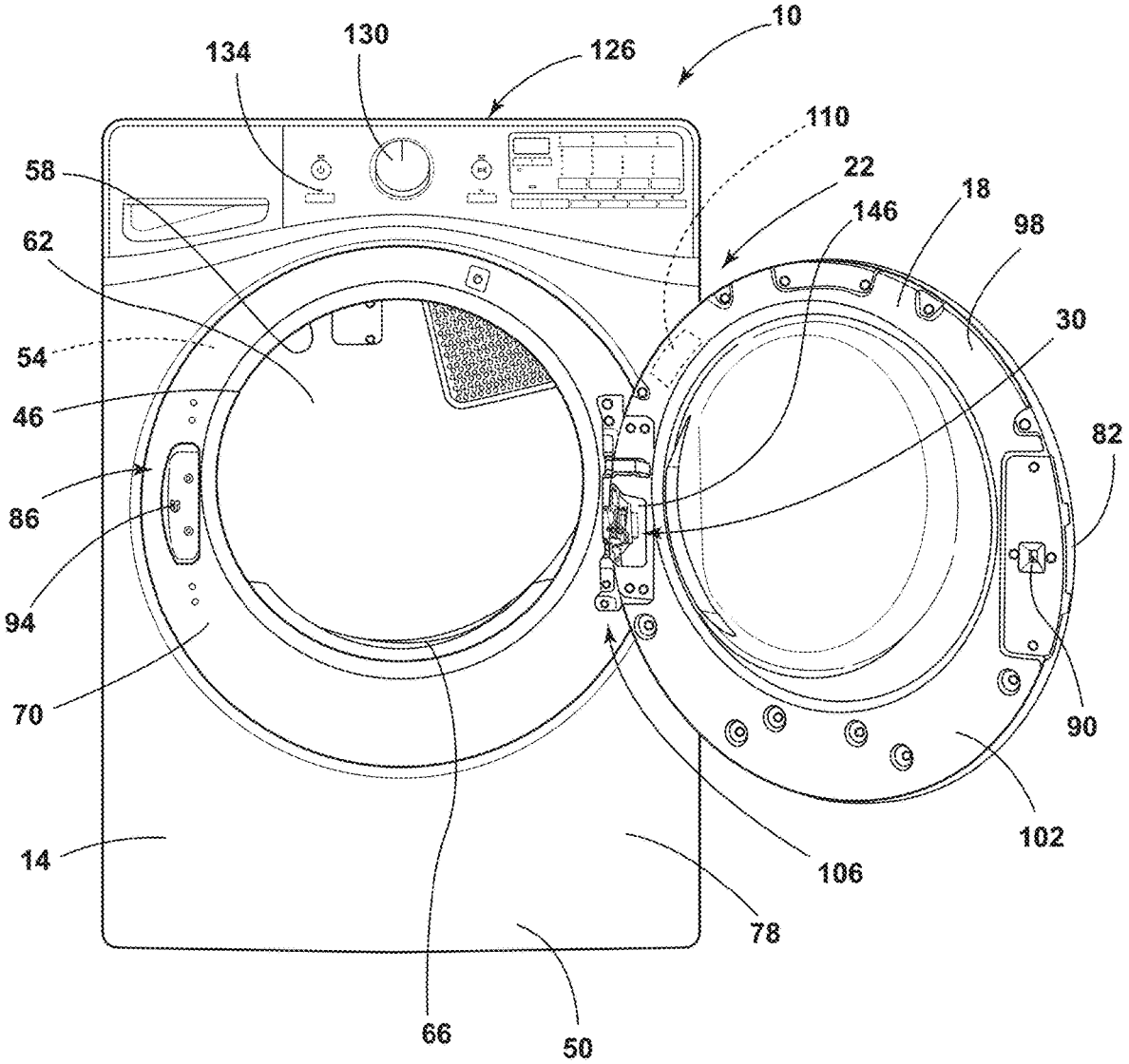
FIG. 2 is a front elevation view of a laundry appliance with a door opening assembly on a door of the laundry appliance, according to the present disclosure.

Referring to FIGS. 1 and 2, the laundry appliance 10 includes the cabinet 14 that defines a front opening 46 in a front panel 50 thereof. A tub 54 is typically disposed within the cabinet 14 and defines an access opening 58 that aligns with the front opening 46 of the cabinet 14. A drum 62 may be disposed within the tub 54 and may have an opening that aligns with the front opening 46 and the access opening 58. Accordingly, the drum 62 is accessible by a user via the front opening 46 and the access opening 58. The laundry appliance 10 is illustrated as a front-load washer, however, the laundry appliance 10 may also be a top-load washer, a dryer, a combination washer/dryer, or other laundry appliance 10. Further, this disclosure is not limited to laundry appliances 10. The door opening assembly 30 may be included in other appliances, such as, for example, refrigerators, freezers, coolers, vacuum insulated structures, storage structures, and other similar appliances and fixtures within household and commercial settings.

In various aspects, the door 18 is operably coupled to the cabinet 14 for alternately sealing and providing access to the front opening 46. In this way, when the door 18 is in the closed position 26, the front opening 46 may be sealed. When the door 18 is in the opened position 22, the user may access the drum 62 through the front opening 46. As illustrated, the door 18 may be a swing door 18 rotatably coupled to the cabinet 14. In such examples, the door 18 may be a flat panel door or a fishbowl-style door. As illustrated in FIGS. 1 and 2, the door 18 opens in a side-to-side manner, however, it is contemplated that the door 18 may open in an up-and-down manner.

According to various aspects, the laundry appliance 10 may include a bellows assembly 66 disposed adjacent to the front opening 46 of the cabinet 14. The bellows assembly 66 may extend between the cabinet 14 and the tub 54. The bellows assembly 66 may prevent items within the drum 62 (e.g., laundry) from moving from the drum 62 into the cabinet 14. In various examples, the tub 54 and the drum 62 may be positioned at an angle within the cabinet 14. As such, the access opening 58 may be offset from the front opening 46. Accordingly, the bellows assembly 66 may be an obliquely-oriented bellows assembly 66. The bellows assembly 66 can be configured to form an oblique cylinder or frusto-conical shape that defines a downward angle between the front opening 46 and the offset tub 54. The bellows assembly 66 may be advantageous for retaining laundry within the tub 54 during a laundry cycle.

Referring still to FIGS. 1 and 2, the front panel 50 may define a recess 70 around the front opening 46. The door 18 may be coupled to the cabinet 14 within the recess 70. When the door 18 is in the closed position 26, an outer surface 74 of the door 18 may be flush with a front panel surface 78 of the cabinet 14. It is also contemplated that the outer surface 74 may be offset from the front panel surface 78. Additionally or alternatively, the door 18 may include a handle 82. The door 18 may curve away from the front panel surface 78 to define a gap therebetween, which may define the handle 82. In this way, the gap may provide space for the hand of the user between the door 18 and the recess 70 to grasp the handle 82.

In various examples, the laundry appliance 10 may include a latch assembly 86 to retain the door 18 in the closed position 26. The latch assembly 86 may include a striker 90 and a strike plate 94. An engagement between the striker 90 and the strike plate 94 typically retains the door 18 in the closed position 26 when the laundry appliance 10 is in operating and non-operating conditions. When engaged, the striker 90 and the strike plate 94 produce a latch force 96 sufficient to retain the door 18 in the closed position 26. To open the door 18, an opening force 100 can be applied to the door 18 and/or the cabinet 14 of the laundry appliance 10 that overcomes the latch force 96 of the latch assembly 86.

Figure 3:
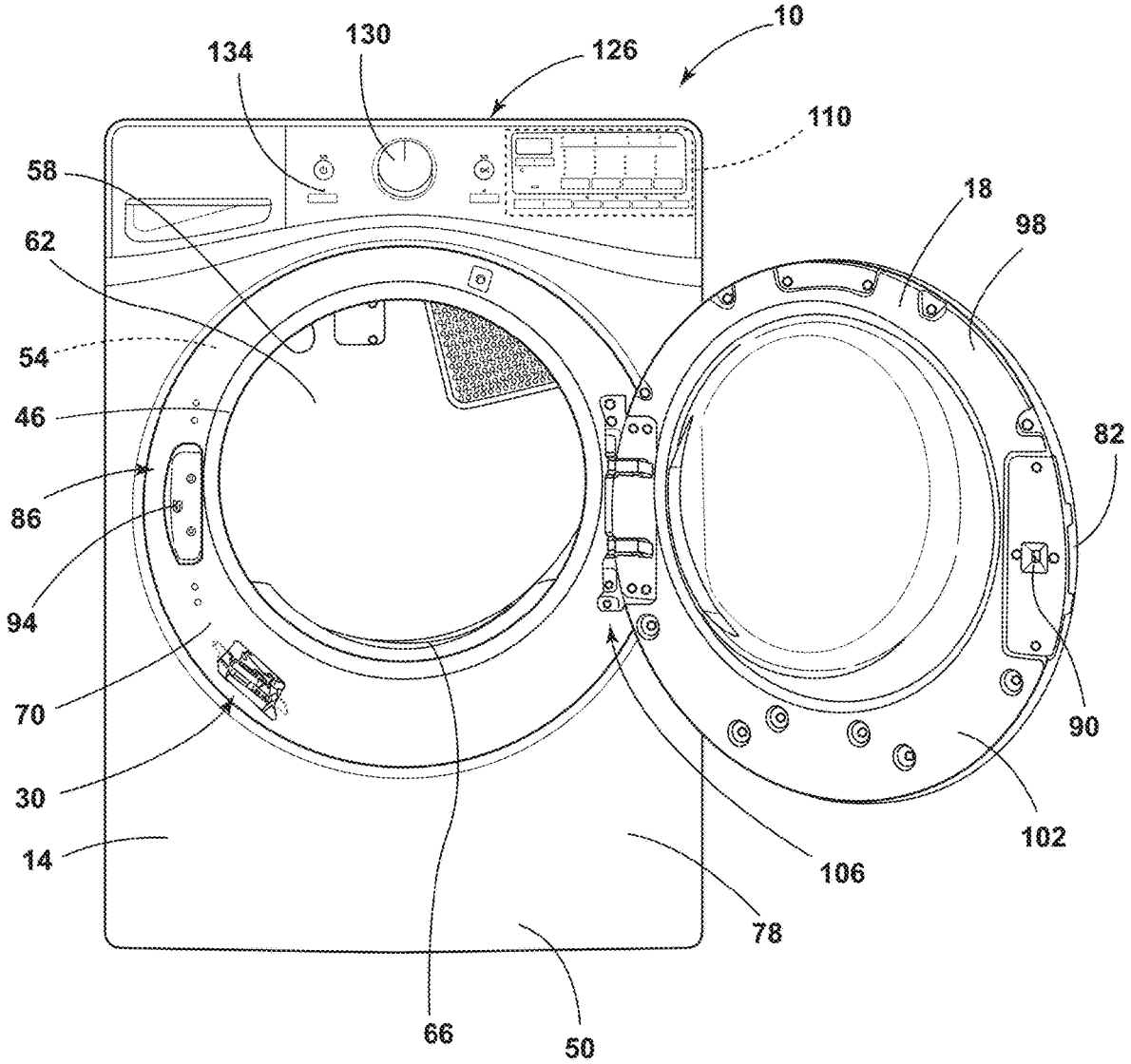
FIG. 3 is a front elevation view of a laundry appliance with a door opening assembly on a cabinet of the laundry appliance, according to the present disclosure.

Referring to FIGS. 2 and 3, the door opening assembly 30 may be coupled to the laundry appliance 10 in a variety of locations. The door opening assembly 30 may be configured to apply the opening force 100 sufficient to overcome the latch force 96 of the latch assembly 86 to open the door 18. As illustrated in FIG. 2, the door opening assembly 30 may be coupled to the door 18. In such examples, the door 18 may include a door panel 98 in which the door opening assembly 30 is coupled. The door opening assembly 30 may be disposed on an inner surface 102 of the door 18 proximate a hinge assembly 106 that is rotatably coupled to door 18 to the cabinet 14. Additionally or alternatively, the door opening assembly 30 may be disposed proximate the striker 90. In this way, the door opening assembly 30 may apply the opening force 100 to the front panel surface 78 proximate the latch assembly 86. When the door opening assembly 30 is disposed on the door 18, the door opening assembly 30 is configured to apply the opening force 100 to the front panel surface 78 to overcome the latch force 96 of the latch assembly 86. It is contemplated that the door opening assembly 30 may be disposed in any practicable location on the door 18.

As illustrated in FIG. 3, in an additional and/or alternative example, the door opening assembly 30 may be coupled to the cabinet 14. In such examples, the door opening assembly 30 may be disposed on the front panel 50 within the recess 70. In this way, the door opening assembly 30 may apply the opening force 100 to the inner surface 102 of the door 18 to overcome the latch force 96 of the latch assembly 86. The door opening assembly 30 is illustrated proximate the latch assembly 86. However, it is contemplated that the door opening assembly 30 may be disposed in any practicable location on the cabinet 14.

Referring still to FIGS. 2 and 3, the door opening assembly 30 may be operably coupled to a controller 110. The controller 110 may be disposed on the door 18, as illustrated in FIG. 2, or may be disposed on the cabinet 14, as illustrated in FIG. 3. According to various aspects, when the door opening assembly 30 is disposed on the door 18, the controller 110 may also be disposed on the door 18. When the door opening assembly 30 may be disposed on the cabinet 14, the controller 110 may also be disposed on the cabinet 14. However, it is also contemplated that when the door opening assembly 30 is disposed on the door 18, the controller 110 is disposed on the cabinet 14. It is further contemplated that when the door opening assembly 30 is disposed on the cabinet 14, the controller 110 may be disposed on the door 18. Additionally or alternatively, the laundry appliance 10 may include more than one controller 110. In such examples, at least one controller 110 may be disposed on the cabinet 14 and at least one controller 110 may be disposed on the door 18.

Figure 4:
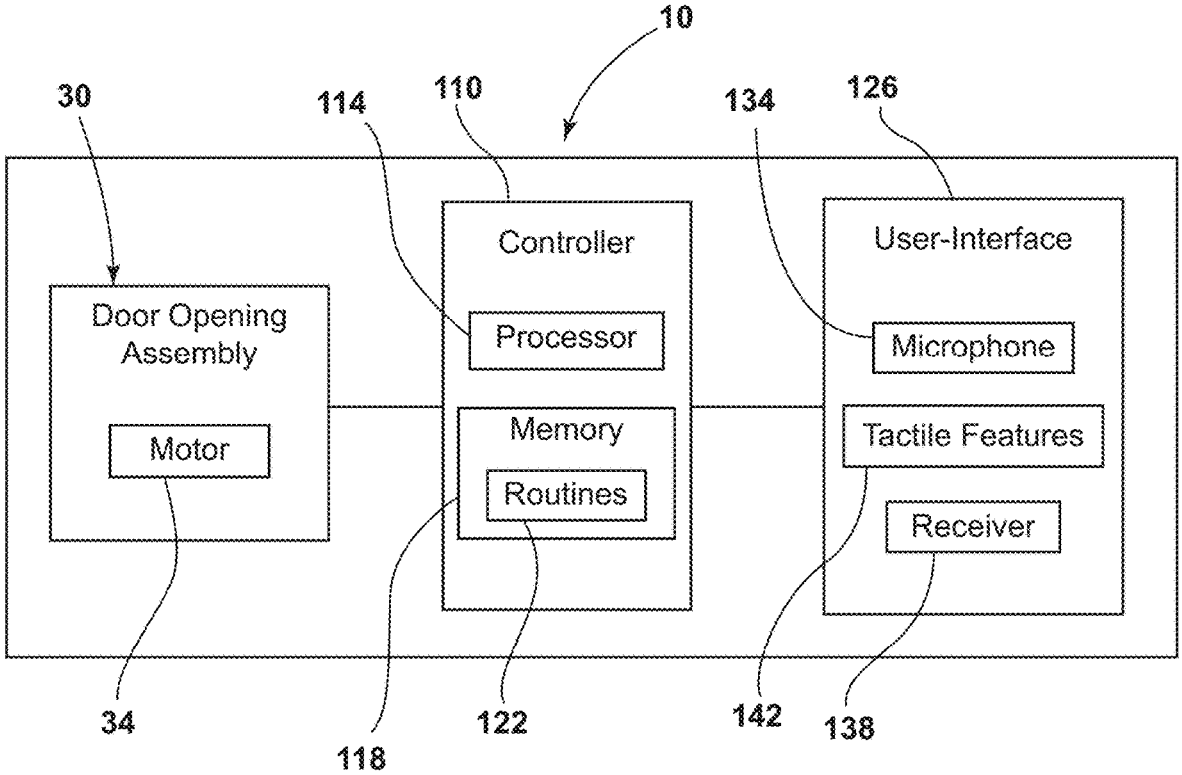
FIG. 4 is a block diagram of a laundry appliance, according to the present disclosure.

Referring to FIG. 4, the controller 110 may include a processor 114, other control circuitry, and a memory 118. Instructions or routines 122 may be included in the memory 118 and are executable by the processor 114. In various aspects, the laundry appliance 10 may include a user-interface 126 for the user to input a command into the laundry appliance 10. The user-interface 126 may include tactile features 130, such as, for example, a button, a switch, a touch panel, or other similar features. The tactile features 130 may allow the user to physically input a command into the laundry appliance 10. Additionally or alternatively, the user-interface 126 may include a microphone 134. The microphone 134 may be configured to receive a voice command from the user. In this way, the user may give a remote command to the laundry appliance 10. Additionally or alternatively still, the user-interface 126 may include a receiver 138. In various examples, the user may use an electronic device (e.g., a phone, a tablet, a computer, etc.) to input a command that may be received by the receiver 138 of the user-interface 126. This may provide an additional and/or alternative method for the user to input a remote command into the laundry appliance 10. The user-interface 126 may send a signal relating to the user command to the controller 110. The controller 110 may then send a corresponding signal to the door opening assembly 30. In examples where the controller 110 and/or the door opening assembly 30 are disposed on the door 18, an electrical connection may be provided between the cabinet 14 and the door 18 to supply power to the controller 110 and/or the door opening assembly 30.

Figure 5:
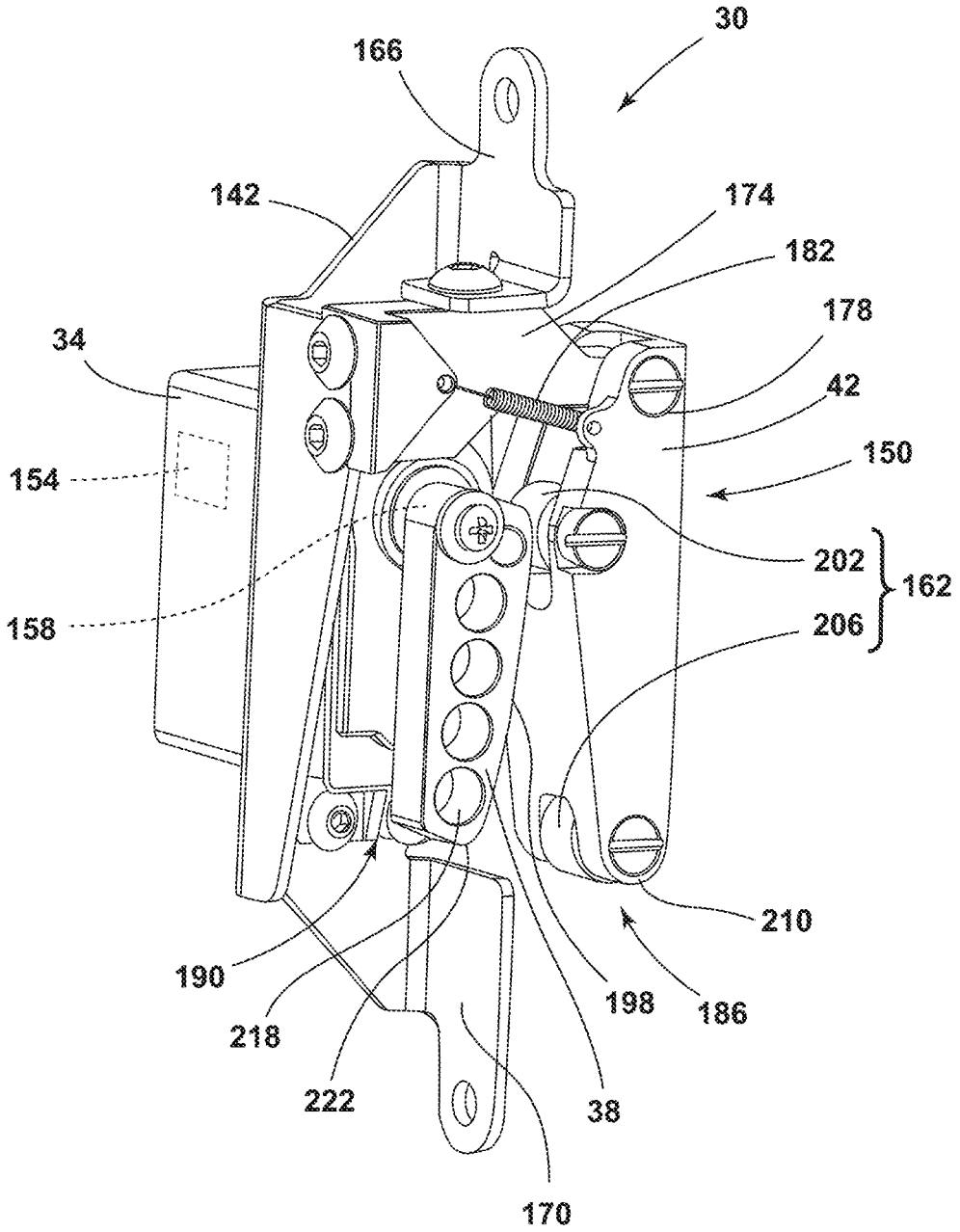
FIG. 5 is a side perspective view of a door opening assembly in a disengaged position, according to the present disclosure.

Referring to FIGS. 2, 3, and 5, the door opening assembly 30 may include a support member 142 for coupling the door opening assembly 30 to the front panel 50 (FIG. 3) and/or the door panel 98 (FIG. 2). The motor 34 may be coupled to the support member 142. In various examples, the laundry appliance 10 may define a motor cavity for receiving the door opening assembly 30. In such examples, the motor 34 may be disposed within the motor cavity. Alternatively, the laundry appliance 10 may include a bracket 146. In such examples, the support member 142 may be coupled to the bracket 146 and the motor 34 may be disposed proximate the bracket 146.

According to various aspects, the door opening assembly 30 may include an actuating cam assembly 150. The actuating cam assembly 150 may be operably coupled to the motor 34 such that the motor 34 may be configured to rotate the actuating cam assembly 150. The actuating cam assembly 150 may include a drive shaft 158 that may include the cam 38. In additional examples, the cam 38 may be integrally formed with the drive shaft 158. Alternatively, the cam 38 may be a separate feature coupled to the drive shaft 158. According to various aspects, the actuating cam assembly 150 may include the actuator arm 42 operably coupled to the cam 38. The actuator arm 42 may be coupled to the support member 142. Additionally or alternatively, the actuating cam assembly 150 may include at least one follower 162. In a non-limiting example, the motor 34 may be configured as a servo motor 34. In such examples, the servo motor 34 may provide for control of the actuating cam assembly 150 to define the angular positions and movement of the actuating cam assembly 150. The motor 34 may be coupled to a sensor 154 that may provide feedback regarding a rotational position of the actuating cam assembly 150 of the motor 34.

Referring still to FIG. 5, the support member 142 may have a generally C-shaped structure. In this way, the motor 34 may be coupled to the support member 142 between first and second arms 166, 170 of the support member 142. Additionally or alternatively, the cam 38 may be disposed between the first and second arms 166, 170. In this configuration, the support member 142 is positioned to not interfere with rotation of the cam 38 by the motor 34. In various examples, the first and second arms 166, 170 are configured to couple to the laundry appliance 10. The first arm 166 may include an extension 174 coupled to the actuator arm 42. The extension 174 may be disposed proximate the first arm 166 and arranged to not interfere with the coupling of the door opening assembly 30 to the laundry appliance 10. The extension 174 may be coupled to a proximal end 178 of the actuator arm 42.

A biasing member 182 may be coupled between the extension 174 and the actuator arm 42. The biasing member 182 may bias the actuator arm 42 to a disengaged position 186. When in the disengaged position 186, the actuator arm 42 may be spaced-apart from an engaging surface (e.g., one of the front panel surface 78 and the inner surface 102 (FIG. 2) of a substrate (e.g., one of the cabinet 14 and the door 18). As illustrated in FIG. 5, when in the disengaged position 186, the actuator arm 42 may have an orientation that is generally parallel with the engaging surface. Based on the arrangement of the door opening assembly 30 and/or the location of the door opening assembly 30 on the laundry appliance 10, the disengaged position 186 may be a substantially vertical orientation, a substantially horizontal orientation, and/or an angled orientation therebetween.

Figure 6:
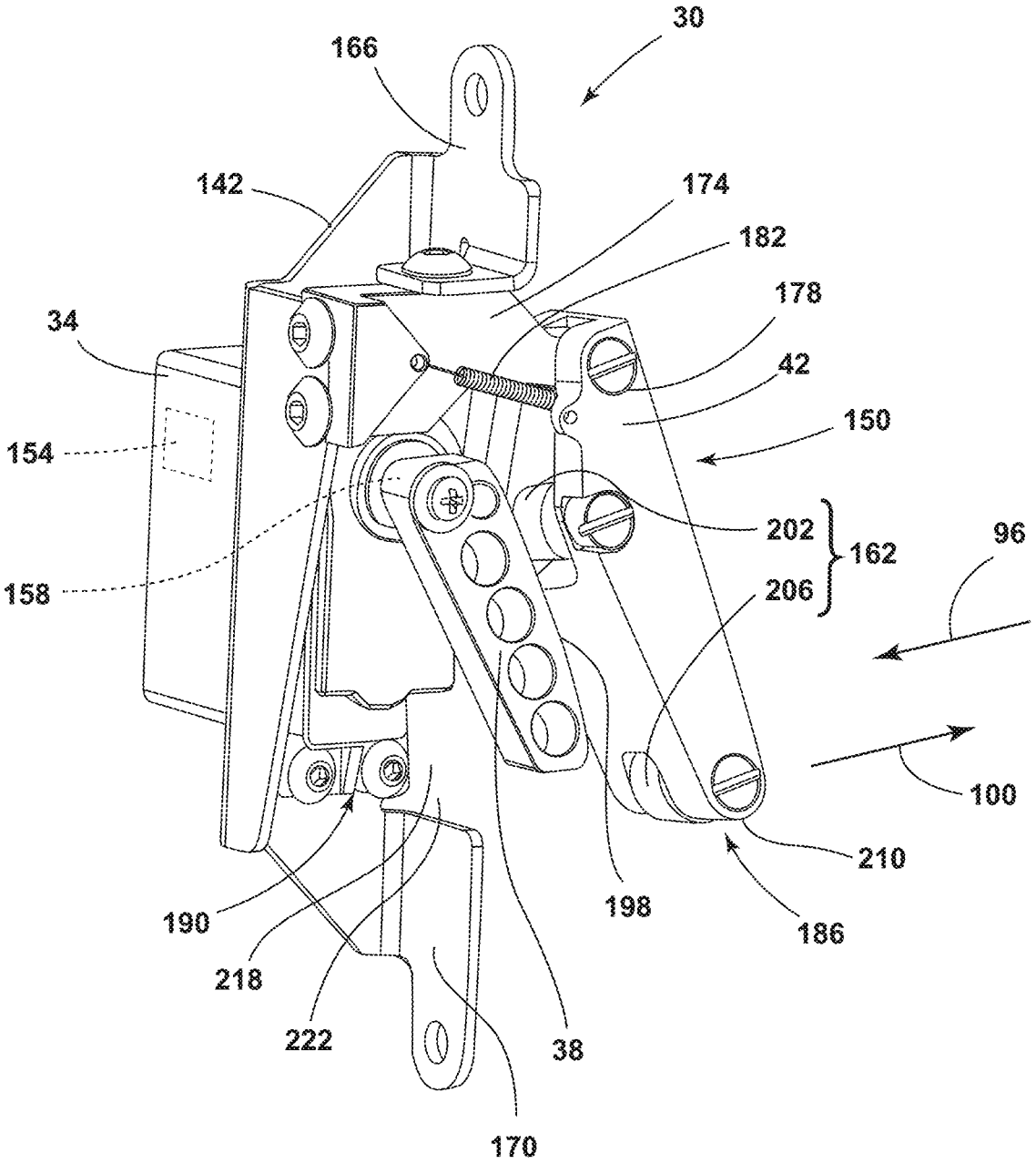
FIG. 6 is a side perspective view of the door opening assembly of FIG. 5 at least partially rotated toward an engaged position.
Figure 7:
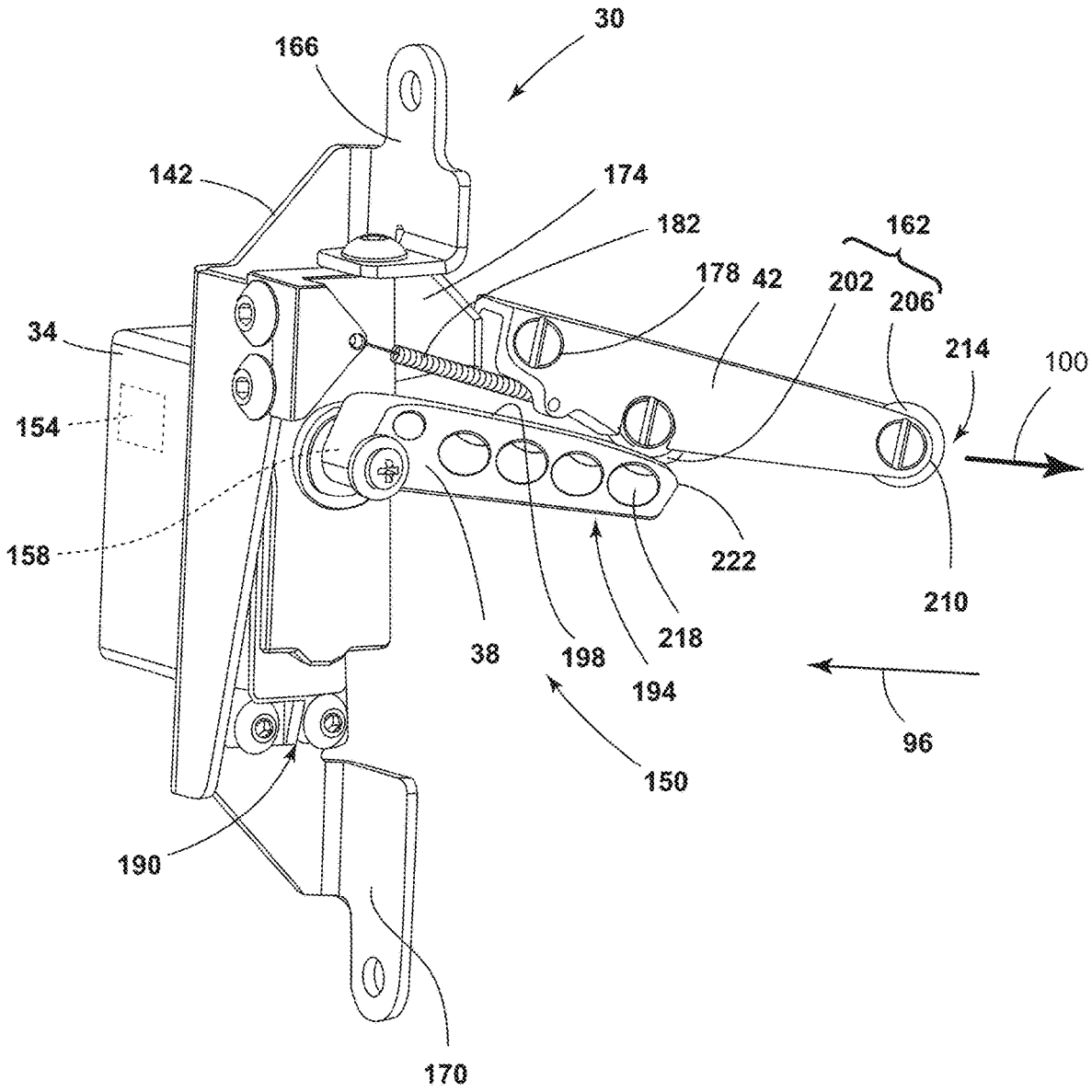
FIG. 7 is a side perspective view of the door opening assembly of FIG. 5 in an engaged position.

Referring to FIGS. 5-7, the motor 34 may be configured to rotate the cam 38 between first and second positions 190, 194 when activated. When in the first position 190, the cam 38 may be in a generally parallel configuration with respect to the engaging surface and proximate to the actuator arm 42, which may also be in the generally vertical orientation. The cam 38 and the actuator arm 42 may be spaced-apart from one another, or alternatively, may be engaged with one another. The motor 34 may rotate the drive shaft 158, and accordingly, the cam 38 toward the actuator arm 42. As the cam 38 rotates, a surface 198 of the cam 38 may engage the actuator arm 42. In various examples, the surface 198 may be curved or sloped to allow the follower 162 to roll along the surface 198. The actuator arm 42 may include a first follower 202 and a second follower 206. The first follower 202 may be coupled to the proximal end 178 of the actuator arm 42 and the second follower 206 may be coupled to a distal end 210 of actuator arm 42.

As the cam 38 rotates, the surface 198 may engage the first follower 202. The curved or sloped configuration of the surface 198 may assist the first follower 202 in rolling or otherwise moving along the surface 198. The rotation of the cam 38 may cause the actuator arm 42 to move from the disengaged position 186 toward an engaged position 214. The cam 38 may be rotated to the second position 194, which may be defined as a predefined angle. The predefined angle may be any angle depending on the configuration of the laundry appliance 10. In a non-limiting example, the predefined angle may be in a range of from about 75° to about 125° relative to the first position 190. The cam 38 may engage the actuator arm 42 and overcome a biasing force of the biasing member 182. In this way, the rotation of the cam 38 to the predefined angle may rotate or otherwise move the actuator arm 42 to a corresponding predetermined angle. According to various aspects, once the cam 38 reaches the predefined angle and the actuator arm 42 reaches the corresponding predefined angle, the cam 38 may be in the second position 194 and the actuator arm 42 may be in the engaged position 214.

Additionally or alternatively, the cam 38 may define one or more apertures 218. The apertures 218 may decrease a weight of the cam 38. In this way, the apertures 218 may contribute to an increased speed of rotation of the cam 38 by the motor 34. It may be advantageous for the cam 38 to define the apertures 218 to increase the speed of rotation of the cam 38 to generate an increased opening force 100. Additionally or alternatively, the decreased weight of the cam 38 may be advantageous for when the motor 34 is less powerful.

The motor 34 may rotate the cam 38 to the first position 190. As the cam 38 returns to the first position 190, the biasing member 182 may act on the actuator arm 42. In this way, the biasing force acts on the actuator arm 42 to return the actuator arm 42 to the disengaged position. The cam 38 may return to the first position 190 after a predetermined amount of time, by user command, or a combination thereof.

Figure 8:
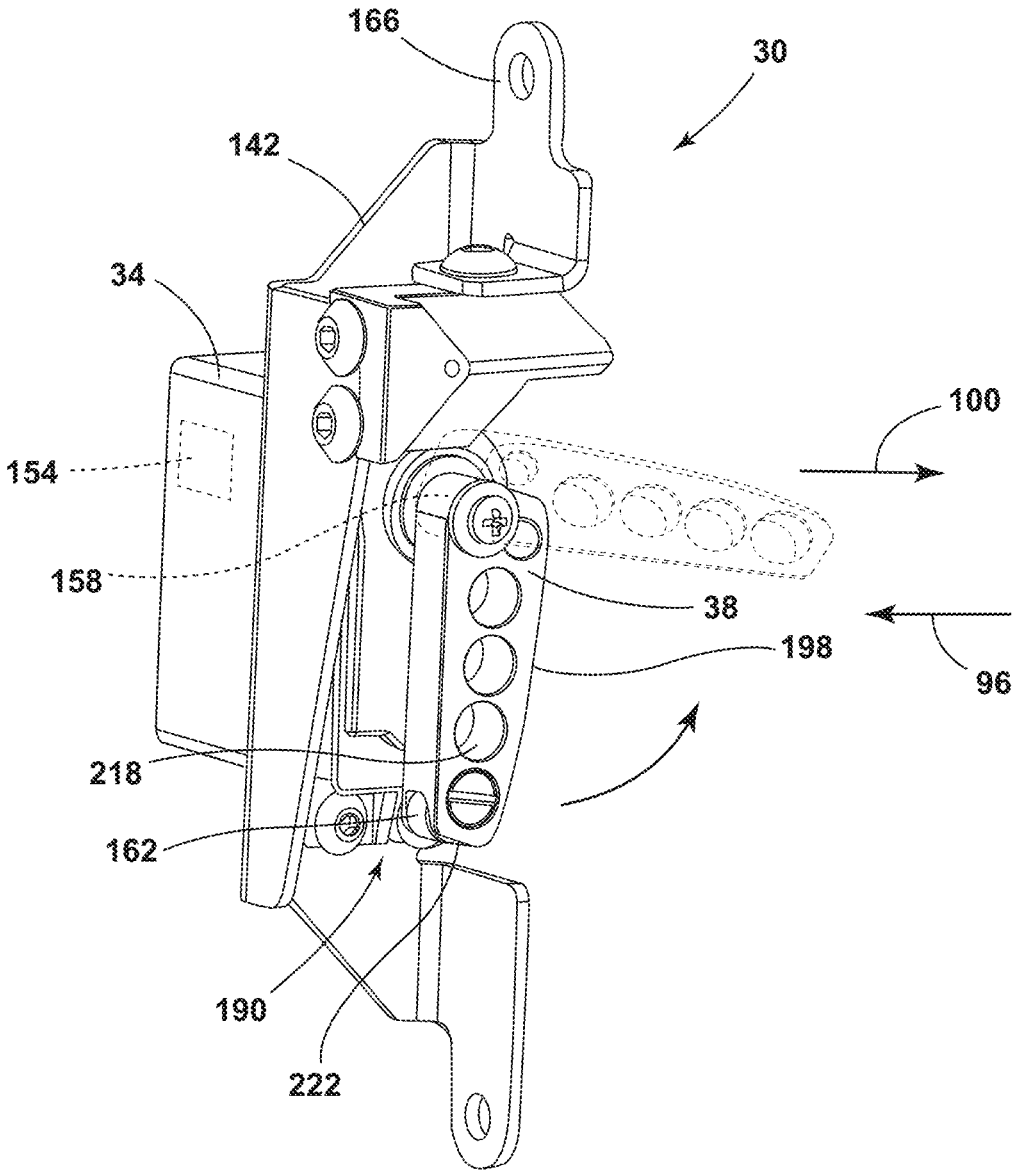
FIG. 8 is a side perspective view of a door opening assembly in a disengaged position, according to this present disclosure.

Referring to FIGS. 2, 3, and 8, in an additional or alternative configuration of the door opening assembly 30, the door opening assembly 30 may not include the actuator arm 42. In this way, the follower 162 may be coupled to an end 222 of the cam 38 opposite the drive shaft 158. In such examples, the motor 34 may rotate the cam 38 from the first position 190 to the second position 194. The follower 162 may be configured to engage one of the front panel 50 and the door panel 98, depending on the location of the door opening assembly 30 on the appliance 10. This configuration may be advantageous where a more powerful motor 34 is used in the door opening assembly 30. The motor 34 may be configured to rotate the cam 38 at a speed and/or with the opening force 100 sufficient to overcome the latch force 96 of the latch assembly 86.

Referring to FIGS. 1, 2, and 4-7, the user may input a command to the laundry appliance 10 via the user-interface 126. The user-interface 126 may send a signal to the controller 110. The controller 110 may send a corresponding signal to the door opening assembly 30. In this way, the motor 34 may be activated via the command (e.g., a remote command) to the controller 110. When activated, the motor 34 may rotate the drive shaft 158, which may correspondingly rotate the cam 38. The cam 38 may be operable between the first and second positions 190, 194.

According to various aspects, a default position of the cam 38 may be the first position 190. The motor 34 may rotate the cam 38 toward the second position 194. As the cam 38 rotates, the surface 198 of the cam 38 may engage the first follower 202 coupled to the actuator arm 42. The cam 38 may overcome the biasing force of the biasing member 182 to move or rotate the actuator arm 42. The actuator arm 42 may be operable between disengaged and engaged positions 186, 214. The biasing member 182 may bias the actuator arm 42 toward the disengaged position 186. As such, the cam 38 may overcome the biasing force to move or rotate the actuator arm 42. The motor 34 may rotate the cam 38 to the predefined angle that defines the second position 194. The first follower 202 may roll along the surface 198 of the cam 38 until the cam 38 is in the second position 194 and the actuator arm 42 is in the engaged position 214.

As the actuator arm 42 rotates, the second follower 206 may engage the front panel surface 78 of the front panel 50 of the laundry appliance 10. Use of the cam 38 and the actuator arm 42 may operate as a force multiplier. Additionally or alternatively, the rotation of the cam 38 and the actuator arm 42 may apply the opening force 100 to the front panel surface 78 sufficient to overcome the latch force 96 of the latch assembly 86. In this way, the door opening assembly 30 may open the door 18 to an ajar position where the latch assembly 86 is disengaged. In the ajar position, the door 18 can be opened with minimal effort on the part of the user. Rotation of the cam 38 to the predefined angle and the actuator arm 42 to the corresponding predefined angle, may define a distance in which the door 18 is opened relative to the cabinet 14. Stated differently, the door opening assembly 30 may open the door 18 a predetermined distance based on the geometry and/or configuration of the cam 38 and actuator arm 42. In such an embodiment, the curvature of the cam 38 may produce the force multiplier effect that can be useful in generating the opening force 100 that overcomes the latch force 96.

Referring to FIGS. 2-8, in examples of the door opening assembly 30 that may not include the actuator arm 42, the door opening assembly 30 may operate in a substantially similar manner. In such examples, the motor 34 may rotate the cam 38 until the follower 162 contacts and/or engages the front panel 50. The cam 38 may then apply the opening force 100 to the front panel 50 so to overcome the latch force 96 of the latch assembly 86. The cam 38 may then continue to rotate to the second position 194 to open the door 18 the predetermined distance relative to the cabinet 14.

Referring to FIGS. 3-7, when the door opening assembly 30 is disposed on the cabinet 14, the door opening assembly 30 may operate in a similar manner as to when the door opening assembly 30 is disposed on the door 18. In such examples, as the actuator arm 42 rotates, the second follower 206 may engage the door panel 98 of the door 18. The cam 38 and the actuator arm 42 may rotate and apply the opening force 100 to the door 18 sufficient to overcome the latch force 96 of the latch assembly 86. The cam 38 and the actuator arm 42 may rotate to open the door 18 to the predetermined distance. According to various aspects, in examples where the door opening assembly 30 may not include the actuator arm 42 and the door opening assembly 30 is disposed on the cabinet 14 (FIGS. 3 and 8), the follower 162 coupled to the cam 38 may engage the door panel 98. The motor 34 may rotate the cam 38 such that the cam 38 applies the opening force 100 to the door 18 sufficient to overcome the latch force 96.

Referring to FIGS. 1-8, in operation, the motor 34 may rotate the cam 38 to the predefined angle. The motor 34 may include software, such as commands and instructions that define the predefined angle to which the cam 38 is rotated. The motor 34 may be communicatively coupled with the sensor 154. The sensor 154 may sense the position of the cam 38 and/or the actuator arm 42. The feedback from the sensor 154 may allow the motor to rotate the cam 38 to the predefined angle. The motor 34 may also include software relating to the distance the door 18 opens relative to the cabinet 14 and/or the rate of rotation of the cam 38. Additionally or alternatively, the controller 110 may include specific routines 122 relating to the predefined angle the cam 38 is rotated, the distance the door 18 is opened relative to the cabinet 14, and/or the rate of rotation of the cam 38.

Use of the present disclosure may provide a variety of advantages. For example, the door opening assembly 30 may be activated via a remote command from the user. In this way, if the user is unable to open the door 18, the door opening assembly 30 may open the door 18 for the user. Additionally, the door opening assembly 30 may be activated via a voice command or a command from an electronic device. Also, the door opening assembly 30 that includes the actuator arm 42 may utilize the actuator arm 42 as a force multiplier. This may be advantageous for use of different motors 34 in the door opening assembly 30 that may rotate the cam 38, and accordingly, the actuator arm 42, at different speeds and powers. Moreover, the door opening assembly 30 may be located in a variety of positions on the laundry appliance 10, which may increase the aesthetics of the laundry appliance 10. Further, the door opening assembly 30 may be a compact configuration, which may decrease space that the door opening assembly 30 uses on the laundry appliance 10. Additionally, the compact configuration of the door opening assembly may reduce energy use of the laundry appliance 10 and may reduce manufacturing costs. Additional benefits or advantages of using this device may also be realized and/or achieved.

According to at least one aspect of the present disclosure, a laundry appliance includes a cabinet and a door rotatably coupled to the cabinet. The door is operable between an opened position and a closed position. A door opening assembly is coupled to one of the cabinet and the door. The door opening assembly includes a motor coupled to a cam. The cam is operably coupled to an actuator arm.

According to another aspect, a biasing member is coupled to an actuator arm. The actuator arm is biased towards a disengaged position.

According to yet another aspect, a cam engages an actuator and overcomes a biasing force of a biasing member to move the actuator arm to an engaged position.

According to still another aspect, an actuator arm is operable between a disengaged position and an engaged position.

According to another aspect, a door opening assembly is coupled to a cabinet. An actuator arm engages an inner surface of the door when in an engaged position.

According to still another aspect, a door opening assembly is coupled to a door. An actuator arm engages a front panel surface of a cabinet when in an engaged position.

According to yet another aspect, each of a cam and an actuator arm rotates to a predefined angle to open a door a predefined distance.

According to another aspect, an actuator arm includes at least one follower.

According to still another aspect, at least one follower includes a first follower coupled to a proximal end of an actuator arm and configured to engage a cam and a second follower coupled to a distal end of the actuator arm and configured to engage one of a door surface and a cabinet surface.

According to another aspect, an actuator includes a first follower that contacts a cam and a second follower that contacts a door.

According to still another aspect, a controller is operably coupled to the motor. The motor is activated via a remote command delivered to the controller.

According to at least one aspect of the present disclosure, a door opening assembly for an appliance includes a support member and a motor coupled to the support member. An actuating cam assembly is operably coupled to the motor. The actuating cam assembly includes a drive shaft that includes a cam and at least one follower. The motor rotates the drive shaft when activated.

According to another aspect, a door opening assembly includes a cabinet panel. A support member is coupled to the cabinet panel. An actuating cam assembly is configured to engage a door.

According to still another aspect, at least one follower is coupled to a distal end of a cam.

According to another aspect, an actuating cam assembly includes an actuator arm coupled to a support member.

According to yet another aspect, at least one follower includes a first follower coupled to a proximal end portion of an actuator arm and a second follower coupled to a distal arm portion of an actuator arm.

According to at least one aspect of the present disclosure, a door opening assembly for an appliance includes a door panel and a support member coupled to the door panel. A motor is coupled to the support member. A cam is operably coupled to the motor. The motor rotates the cam to a predefined angle. An actuator arm is coupled to the support member. The actuator arm is rotated to a corresponding predefined angle by the cam. The actuator arm is configured to engage an engaging surface of a substrate.

According to another aspect, a first follower is coupled to a proximal end portion of an actuator arm to engage a cam. A second follower is coupled to a distal end portion of the actuator arm to engage an engaging surface.

According to still another aspect, an actuator arm is operable between a disengaged position and an engaged position. The actuator arm is spaced-apart from an engaging surface when in the disengaged position.

According to yet another aspect, a controller is operably coupled to a motor. The motor is activated via a remote command to the controller.

It will be understood by one having ordinary skill in the art that construction of the described disclosure and other components is not limited to any specific material. Other exemplary embodiments of the disclosure disclosed herein may be formed from a wide variety of materials, unless described otherwise herein.

For purposes of this disclosure, the term "coupled" (in all of its forms, couple, coupling, coupled, etc.) generally means the joining of two components (electrical or mechanical) directly or indirectly to one another. Such joining may be stationary in nature or movable in nature. Such joining may be achieved with the two components (electrical or mechanical) and any additional intermediate members being integrally formed as a single unitary body with one another or with the two components. Such joining may be permanent in nature or may be removable or releasable in nature unless otherwise stated.

It is also important to note that the construction and arrangement of the elements of the disclosure as shown in the exemplary embodiments is illustrative only. Although only a few embodiments of the present innovations have been described in detail in this disclosure, those skilled in the art who review this disclosure will readily appreciate that many modifications are possible (e.g., variations in sizes, dimensions, structures, shapes and proportions of the various elements, values of parameters, mounting arrangements, use of materials, colors, orientations, etc.) without materially departing from the novel teachings and advantages of the subject matter recited. For example, elements shown as integrally formed may be constructed of multiple parts or elements shown as multiple parts may be integrally formed, the operation of the interfaces may be reversed or otherwise varied, the length or width of the structures and/or members or connector or other elements of the system may be varied, the nature or number of adjustment positions provided between the elements may be varied. It should be noted that the elements and/or assemblies of the system may be constructed from any of a wide variety of materials that provide sufficient strength or durability, in any of a wide variety of colors, textures, and combinations. Accordingly, all such modifications are intended to be included within the scope of the present innovations. Other substitutions, modifications, changes, and omissions may be made in the design, operating conditions, and arrangement of the desired and other exemplary embodiments without departing from the spirit of the present innovations.

It will be understood that any described processes or steps within described processes may be combined with other disclosed processes or steps to form structures within the scope of the present disclosure. The exemplary structures and processes disclosed herein are for illustrative purposes and are not to be construed as limiting.

What is claimed is:

1. A door opening assembly for an appliance, comprising:

a support member;

a motor coupled to the support member; and an actuating cam assembly operably coupled to the motor, wherein the actuating cam assembly is operable between a first position and a second position, wherein the actuating cam assembly includes:

a drive shaft including a cam, wherein the motor rotates the drive shaft when activated to drive rotation of the cam about a cam rotational axis, and wherein the cam has a first end operably coupled to the motor and a second end;

an actuator arm having an arm rotational axis, wherein the actuator arm has a proximal end operably coupled to the support member and a distal end, and wherein the proximal end of the actuator arm is disposed proximate to the first end of the cam when the actuating cam assembly is in the first position and disposed proximate to the second end of the cam when the actuating cam assembly is in the second position; and at least one follower coupled to the actuator arm.

2. The door opening assembly of claim 1, further comprising:

a door, wherein the support member is coupled to the door, and wherein the actuating cam assembly is configured to engage a cabinet panel.

3. The door opening assembly of claim 1, wherein the cam rotational axis is offset from the arm rotational axis.

4. The door opening assembly of claim 1, further comprising:

a cabinet panel, wherein the support member is coupled to the cabinet panel, and wherein the actuating cam assembly is configured to engage a door.

5. The door opening assembly of claim 1, further comprising:

a biasing member extending between the support member and the actuator arm to bias the actuating cam assembly toward the first position.

6. The door opening assembly of claim 1, wherein the at least one follower is coupled to the distal end of the actuator arm.

7. The door opening assembly of claim 1, wherein the at least one follower includes a first follower coupled to the proximal end of the actuator arm and a second follower coupled to the distal end of the actuator arm.

8. An appliance door opening assembly, comprising:

a motor;

a cam having a proximal end operably coupled to the motor, wherein the motor drives rotation of the cam between a first position and a second position; and an actuator arm selectively engaged with the cam and operable between an engaged position and a disengaged position, wherein an end of the actuator arm is disposed proximate to a proximal end of the cam when the cam is in the first position and the actuator arm is in the disengaged position, and wherein the end of the actuator arm is disposed proximate to a distal end of the cam when the cam is in the second position and the actuator arm is in the engaged position, and wherein the actuator arm pivots about the end of the actuator arm.

9. The appliance door opening assembly of claim 8, wherein a cam rotational axis of the cam is offset from an arm rotational axis of the actuator arm.

10. The appliance door opening assembly of claim 9, wherein the cam rotational axis is parallel to the arm rotational axis.

11. The appliance door opening assembly of claim 8, wherein a cam surface of the cam is generally parallel with the actuator arm during operation between the engaged position and the disengaged position.

12. The appliance door opening assembly of claim 8, wherein the actuator arm engages at least one of a door panel and a cabinet when in the engaged position.

13. The appliance door opening assembly of claim 8, further comprising:

a support member, wherein the proximal end of the cam is operably coupled to the support member; and a biasing member coupled to the actuator arm and the support member and configured to bias the actuator arm toward the disengaged position.

14. The appliance door opening assembly of claim 8, further comprising:

a first follower coupled to the actuator arm and a second follower coupled to the actuator arm, wherein the first follower is configured to engage at least one of a cabinet and a door when the actuator arm is in the engaged position.

15. The appliance door opening assembly of claim 14, wherein the second follower is configured to engage a cam surface of the cam as the cam is rotated between the first position and the second position.

16. The appliance door opening assembly of claim 8, wherein the cam defines a plurality of apertures.

17. A door opening assembly for an appliance door, comprising:

a door panel;

a support member coupled to the door panel;

a motor coupled to the support member;

a cam operably coupled to the motor, wherein the motor rotates the cam from a first position to a second position at a predefined angle; and an actuator arm having a first end coupled to the support member, wherein the actuator arm is configured to engage an engaging surface of a substrate, wherein the actuator arm is rotated from a disengaged position to an engaged position at a corresponding predefined angle by the cam, and wherein the first end of the actuator arm is disposed proximate a proximal end of the cam when the cam is in the first position and the actuator arm is in the disengaged position, and the first end is disposed proximate to a distal end of the cam when the cam is in the second position and the actuator arm is in the engaged position.

18. The door opening assembly of claim 17, further comprising:

a first follower coupled to the first end of the actuator arm to engage the cam and a second follower coupled to the second end of the actuator arm to engage the engaging surface.

19. The door opening assembly of claim 17, wherein the actuator arm is spaced-apart from the engaging surface when in the disengaged position.

20. The door opening assembly of claim 17, further comprising:

a controller operably coupled to the motor, wherein the motor is activated via a remote command to the controller.

* * * * *